US008103135B2

(12) United States Patent
Head

(10) Patent No.: US 8,103,135 B2
(45) Date of Patent: Jan. 24, 2012

(54) WELL BORE SENSING

(76) Inventor: Philip Head, Bagshot, Surrey (GB)

( * ) Notice: Subject to any disclaimer, the term of this patent is extended or adjusted under 35 U.S.C. 154(b) by 0 days.

(21) Appl. No.: 11/886,407

(22) PCT Filed: Mar. 16, 2006

(86) PCT No.: PCT/GB2006/050057

§ 371 (c)(1),
(2), (4) Date: Sep. 13, 2007

(87) PCT Pub. No.: WO2006/097772

PCT Pub. Date: Sep. 21, 2006

(65) Prior Publication Data

US 2008/0181555 A1 Jul. 31, 2008

(30) Foreign Application Priority Data

| | | |
|---|---|---|
| Mar. 16, 2005 | (GB) | 0505363.2 |
| Jun. 1, 2005 | (GB) | 0511151.3 |
| Jul. 12, 2005 | (GB) | 0514258.3 |
| Sep. 7, 2005 | (GB) | 0518205.0 |
| Sep. 8, 2005 | (GB) | 0518330.6 |
| Feb. 2, 2006 | (GB) | 0602077.0 |

(51) Int. Cl.
*G02B 6/26* (2006.01)
*G02B 6/34* (2006.01)

(52) U.S. Cl. ..... 385/12; 385/37

(58) Field of Classification Search ..... 385/112, 385/37

See application file for complete search history.

(56) References Cited

U.S. PATENT DOCUMENTS

| | | | | |
|---|---|---|---|---|
| 5,892,860 | A * | 4/1999 | Maron et al. | 385/12 |
| 6,442,304 | B1 * | 8/2002 | Crawley et al. | 385/12 |
| 6,445,868 | B1 * | 9/2002 | Grunbeck et al. | 385/138 |
| 6,817,257 | B2 * | 11/2004 | Kluth et al. | 73/866.5 |
| 6,888,972 | B2 * | 5/2005 | Berg et al. | 385/12 |
| 6,978,832 | B2 * | 12/2005 | Gardner et al. | 166/250.1 |
| 7,028,543 | B2 * | 4/2006 | Hardage et al. | 73/152.01 |
| 2002/0181909 | A1 * | 12/2002 | Grunbeck et al. | 385/123 |
| 2002/0194932 | A1 * | 12/2002 | Gysling et al. | 73/861.42 |
| 2003/0172752 | A1 * | 9/2003 | Kluth et al. | 73/866.5 |
| 2004/0047534 | A1 * | 3/2004 | Shah et al. | 385/12 |
| 2004/0141420 | A1 * | 7/2004 | Hardage et al. | 367/149 |
| 2005/0036140 | A1 * | 2/2005 | Elster et al. | 356/246 |
| 2005/0263281 | A1 * | 12/2005 | Lovell et al. | 166/255.1 |
| 2007/0272406 | A1 * | 11/2007 | McCoy et al. | 166/250.01 |

* cited by examiner

*Primary Examiner* — K. Cyrus Kianni
(74) *Attorney, Agent, or Firm* — Andrew Wilford

(57) ABSTRACT

A sensor system for use in a well bore includes a metal-clad fiber-optic cable, the fiber optic cable include one or more Bragg gratings, and each Bragg grating is configured such that a value or change in a physical parameter to be measured results in a measurable value or change in the Bragg grating. The sensor system is included in a tool moveable through a drill string. The Bragg gratings are subjected to a strain related to the well bore's pressure, such that the pressure can be determined from the characteristics of the Bragg grating.

7 Claims, 15 Drawing Sheets

WELL BORE SENSING

CROSS REFERENCE TO RELATED APPLICATIONS

This application is the US national phase of PCT application PCT/GB2006/050057, filed 16 Mar. 2006, published 21 Sep. 2006 as WO 2006/097772, and claiming the priority of British patent applications 0505363.2, 051151.3, 0514258.3, 0518205.0, 0518330.6, and 0602077.0 respectively filed 16 Mar. 2005, 1 Jun. 2005, 12 Jul. 2005, 7 Sep. 2005, 8 Sep. 2005, and 2 Feb. 2006 and PCT patent application PCT/GB2006/050057 itself filed 16 Mar. 2006, whose entire disclosures are herewith incorporated by reference.

FIELD OF THE INVENTION

The present invention relates to well bore sensing, that is, using sensors to measure physical parameters of a well bore.

BACKGROUND OF THE INVENTION

There are many different parameters which one may wish to measure in a well, some associated with the general well environment, and others relating to particular stages in the completion and production of the well, and even to particular procedures carrying out in the well.

Particular instances where it is desired to measure conditions include production testing of wells, which is a well established practice to understand which zones are in production and what they are producing from a well. Another example is the monitoring of changes in the internal diameter of a flow path in an oil well casing which may be subject to reduction in diameter through deposition of scale, or through formation collapse, or to an increase in diameter caused by corrosion or mechanical damage.

Other instances of well sensing occur when it is desired to monitor the performance of a particular tool or part of a tool. For example, during gas lift of a well (where gas is used to help lift hydrocarbons from reservoir to surface), gas is injected under pressure from the surface into the production tubing annulus. Down the length of the production tubing are located gas lift valves. Each are set to a pre defined cracking pressure, so that they meter gas into the production tubing, which in turn helps to lift the oil to surface. If a valve is not working correctly or is not allowing sufficient gas to enter the production tubing, then production is not optimized and the net flow rate is not maximized.

Conventional tools used to perform these measurements typically require electrical power; for example, in measuring the flow rate, a flow diverter is used to direct the flow to the central area of the production tubing where a turbine flow meter is used to determine the combined flow at that point in the well.

It will be appreciated that any sensors and also require associated electronics, power supplies and associated hardware has to tolerate the harsh chemical, temperature and pressures subjected to at depth in an oil or gas well.

A common type of communications link includes a wireline in which one or more electrical conductors route power and data between a downhole component and the surface equipment. Other conveyance structures can also carry electrical conductors to enable power and data communications between a downhole component and surface equipment. To communicate over an electrical conductor, a downhole component typically includes electrical circuitry and sometimes power sources such as batteries. Such electrical circuitry and power sources are prone to failure for extended periods of time in the typically harsh environment (high temperature and pressure) that is present in a wellbore.

Another issue associated with running electrical conductors in a wireline, or other type of conveyance structure, is that in many cases the wireline extends a an intervention, remedial, or investigative tool into a wellbore. Conventionally, such intervention, remedial, or investigative tools are carried by a wireline, slickline, coiled tubing, or some other type of conveyance structure. If communication is desired between the intervention, remedial, or investigative tool and the surface equipment, electrical conductors are run through the conveyance structure. As noted above, electrical conductors are associated with various issues that may prove impractical in some applications.

OBJECT OF THE INVENTION

It is an object of this invention to eliminate the need for electrically powered sensors, and to alleviate the problems outlined above.

SUMMARY OF THE INVENTION

According to the present invention there is provided a sensor system for use in a well bore including a metal-clad fiber-optic cable, the fiber optic cable include one or more Bragg gratings, each Bragg grating being configured such that a value or change in a physical parameter to be measured results in a measurable value or change in the Bragg grating.

According to another aspect of the present invention, there is provided a sensor system for use in a well bore including a fiber-optic cable, the fiber optic cable include one or more Bragg gratings, each Bragg grating being configured such that a value or change in a physical parameter to be measured results in a measurable value or change in the Bragg grating.

According to another aspect of the present invention, there is provided a sensor system for use in a well bore including a fiber-optic cable, the fiber optic cable include one or more Bragg gratings, each Bragg grating being configured such that a value or change in a physical parameter to be measured results in a measurable value or change in the Bragg grating.

According to another aspect of the present invention, there is provided a sensor system for use in a well bore including a fiber-optic cable, the fiber optic cable include one or more Bragg gratings, each Bragg grating being configured such that a value or change in a physical parameter to be measured results in a measurable value or change in the Bragg grating, the Bragg gratings being suspended from the fiber-optic cable.

Bragg grating sensors can measure local strain, this can be used to determine, pressure, differential pressure, acceleration, temperature etc. By directing the fluid flow through a venturi, and measuring the pressure at the entrance and throat it is possible to deduce the flow rate. This eliminates electrically powered sensors yet can achieve all the measurements required up to temperatures at least as high as high as 300° C. Strain on the Bragg gratings may be induced mechanically, hydraulically, electrically, or magnetically.

Sensors for the measurement of various physical parameters such as pressure and temperature often rely on the transmission of strain from an elastic structure (e.g., a diaphragm, bellows, etc.) to a sensing element. In a pressure sensor, the sensing element may be bonded to the elastic structure with a suitable adhesive. An industrial process sensor is typically a transducer that responds to a measure and with a sensing element and converts the variable to a standardized transmission signal, e.g., an electrical or optical signal, that is a function of the measure. Industrial process sensors utilize transducers that include pressure measurements of an industrial process such as that derived from slurries, liquids, vapors and gasses in refinery, chemical, pulp, petroleum, gas, pharmaceutical, food, and other fluid processing plants. Industrial process sensors are often placed in or near the process fluids, or in field applications. Often, these field applications are subject to harsh and varying environmental conditions that provide challenges for designers of such sensors. Typical electronic, or other, transducers of the prior art often cannot be placed in industrial process environments due to sensitivity to electromagnetic interference, radiation, heat, corrosion, fire, explosion or other environmental factors. It is also known that the attachment of the sensing element to the elastic structure can be a large source of error if the attachment is not highly stable. In the case of sensors that measure static or very slowly changing parameters, the long term stability of the attachment to the structure is extremely important. A major source of such long term sensor instability is a phenomenon known as "creep", i.e., change in strain an the sensing element with no change in applied load on the elastic structure, which results in a DC shift or drift error in the sensor signal. Certain types of fiber optic sensors for measuring static and/or quasi-static parameters require a highly stable, very low creep attachment of the optical fiber to the elastic structure. Various techniques exist for attaching the fiber to the structure to minimize creep, such as adhesives, bonds, epoxy, cements and/or solders. However, such attachment techniques may exhibit creep and/or hysteresis over time and/or high temperatures. One example of a fiber optic based sensor is that described in U.S. Pat. No. 6,016,702 entitled "High Sensitivity Fiber Optic Pressure Sensor for Use in Harsh Environments" to Robert J. Maron, which is incorporated herein by reference in its entirety. In that case, an optical fiber is attached to a compressible bellows at one location along the fiber and to a rigid structure at a second location along the fiber with a Bragg grating embedded within the fiber between these two fiber attachment locations and with the grating being in tension. As the bellows is compressed due to an external pressure change, the tension on the fiber grating is reduced, which changes the wavelength of light reflected by the grating. If the attachment of the fiber to the structure is not stable, the fiber may move (or creep) relative to the structure it is attached to, and the aforementioned measurement inaccuracies occur. In another example, a optical fiber Bragg grating pressure sensor where the fiber is secured in tension to a glass bubble by a UV cement is discussed in Xu, M. G., Beiger, H., Dakein, J. P.; "Fibre Grating Pressure Sensor With Enhanced Sensitivity Using A Glass-Bubble Housing", Electronics Letters, 1996, Vol. 32, pp. 128-129. However, as discussed hereinbefore, such attachment techniques may exhibit creep and/or hysteresis over time and/or high temperatures, or may be difficult or costly to manufacture.

BRIEF DESCRIPTION OF THE DRAWING

The invention will now be described, by way of example, with reference to the drawings, of which.

SPECIFIC DESCRIPTION

Figure 2:
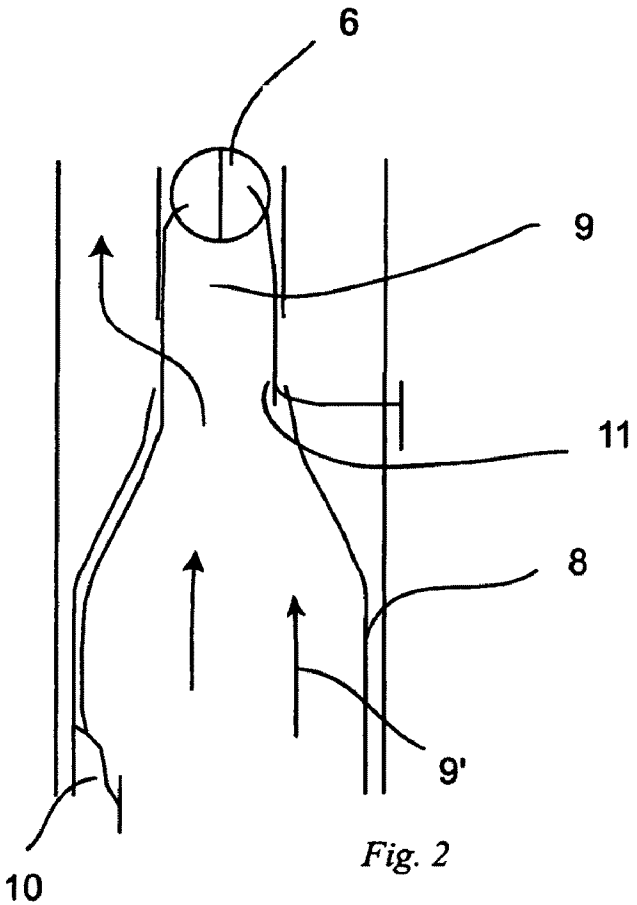
FIG. 2 is a more detailed sectional side view of the tool shown in FIG. 1.
Figure 1A:
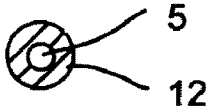
FIG. 1*a* is a cross sectional view of the wireline upon which the tool is suspended.
Figure 1:
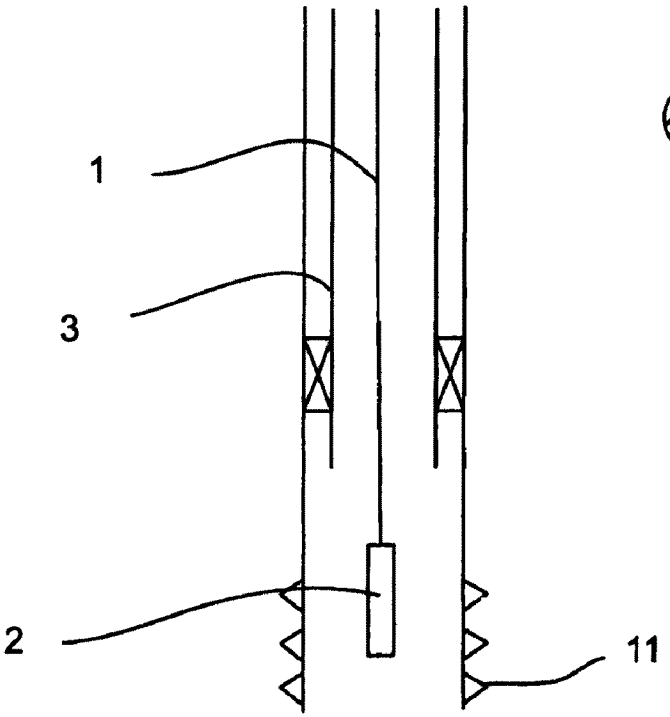
FIG. 1 is a side view of a tool, as deployed through the production tubing of a well.
Figure 3:
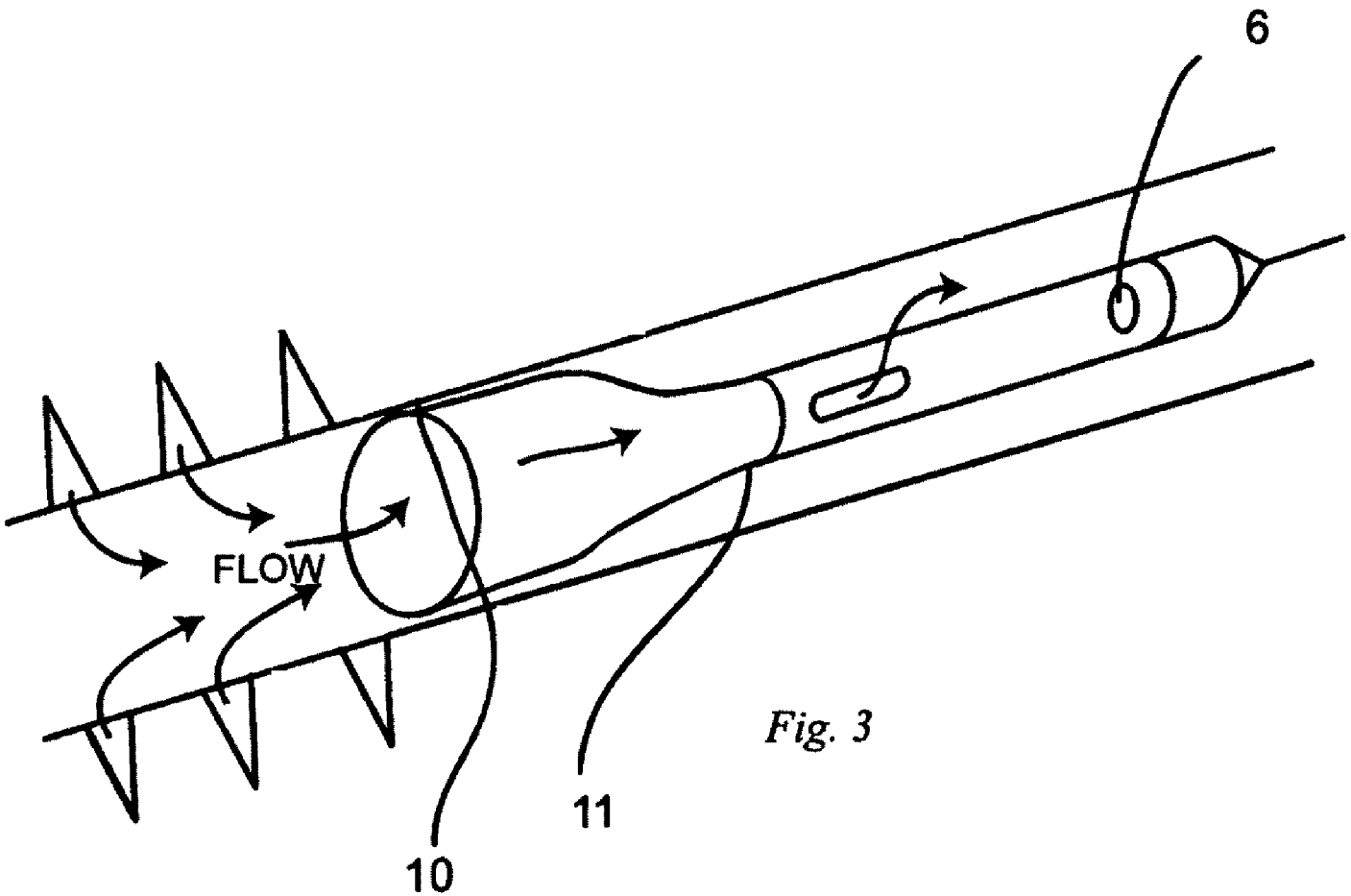
FIG. 3 is a perspective view of the assembly shown in FIG. 2.

Referring to FIG. 1, a slick line 1 (metal wire) is used to lower and raise a tool assembly 2 through production tubing 3 into the reservoir section of a well 4. The slick line comprises a central fiber optic cable 5 surrounded by a supporting layer 12 as shown in FIG. 1*a*, this fiber optic cable being used to monitor the condition of a series of Bragg grating fiber optic sensors 6. Referring to FIGS. 2 and 3, once the tool reaches the maximum depth in the well, it is moved upwards, and bow springs attached to the tool trigger a flow diverter 8 to deploy, which causes all the flow from the well to pass through the throat 9 of the flow diverter. Capillary tubes 10 and 11 located at the flow inlet 9' and throat 9 of the flow diverter or venturi 12 are connected to a Bragg grating differential pressure sensor 6, the fiber optic cable from the surface interrogates this sensor and from this data can be derived the flow rate at that point in the well. The Bragg grating will be described in more detail below, but is very much simpler than for example a Wheatstone bridge type sensor.

Figures 4, 4A, 5:
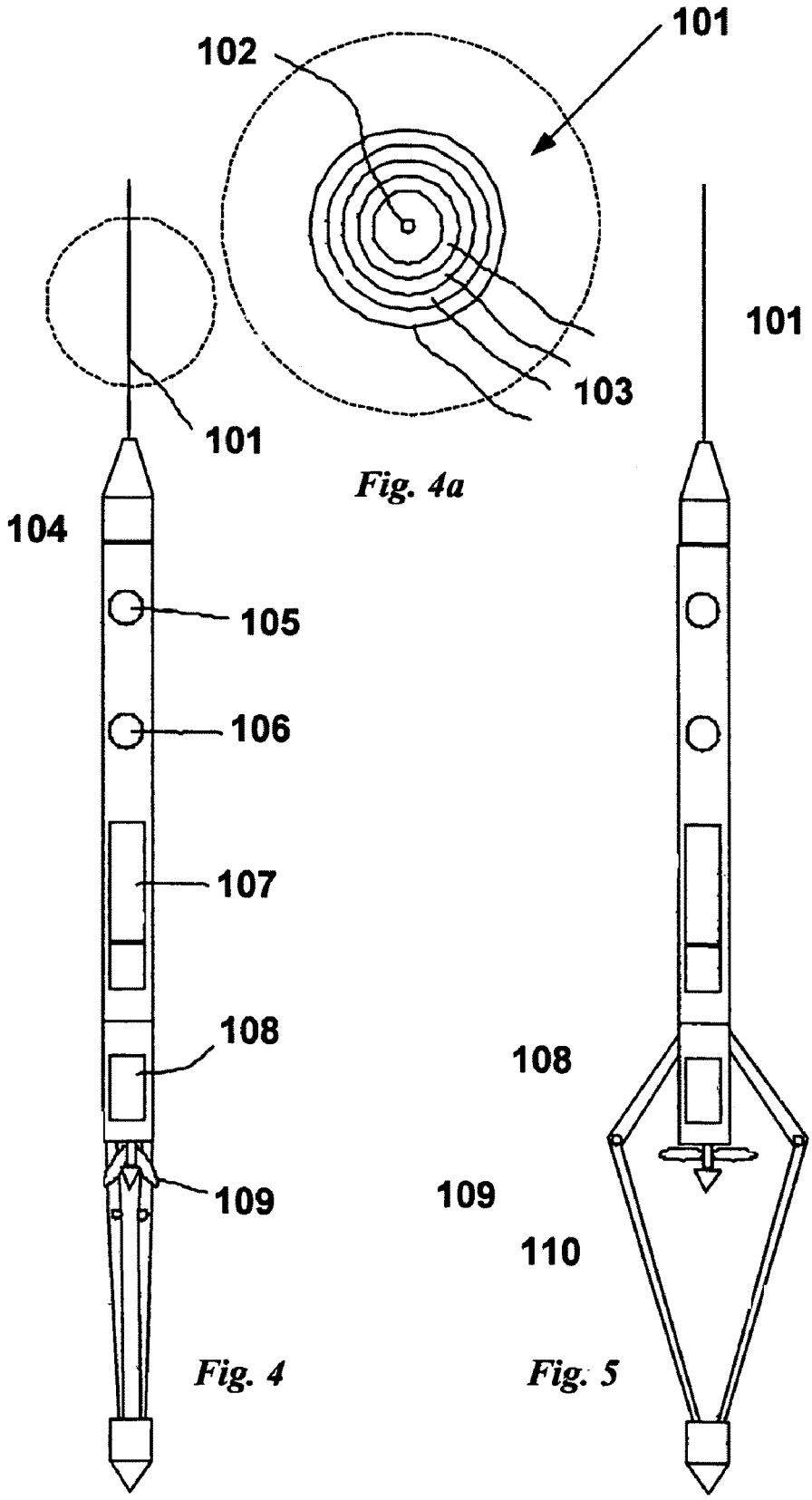
FIG. 4 is a side view of a typical production logging tool suspended on a slickline with fiber optic cable up its center.
FIG. 4*a* is cross section of the slickline, and which shows the slickline multi layer construction.
FIG. 5 shows the logging tool of FIG. 4 with its centralizer deployed and a turbine flowmeter in its open position.

Referring to FIGS. 4, 4*a* and 5, there is shown the general arrangement for a further embodiment of a downhole production logging tool. The tool is lowered into the well on a multi-skinned slickline shown in FIG. 4*a*, where a fiber-optic cable is encased in multiple layers of supporting material such as steel. The slickline is constructed using thin wall sheet stainless steel 103 (or other suitable weldable material) which is formed around the fiber one layer at a time. Each layer-is formed into a tube around the fiber from a strip of steel, and then laser welded along the seam so as to reduce the amount of heat that the fiber experiences. Heat shielding may also be used, particularly for the first layers. The tube is initially formed with an internal diameter larger than the outer diameter of the fiber (or the previous tube) that it is formed over, and then the tube is swaged down to a snug fit. It is easier to form several relatively thin layers into tubes and swage them to fit, than it is to do the same with a single piece of material of having the same total thickness. The use of several separate layers results in a line which is very strong with high tensile load carrying capability and has a small diameter.

Figure 6:
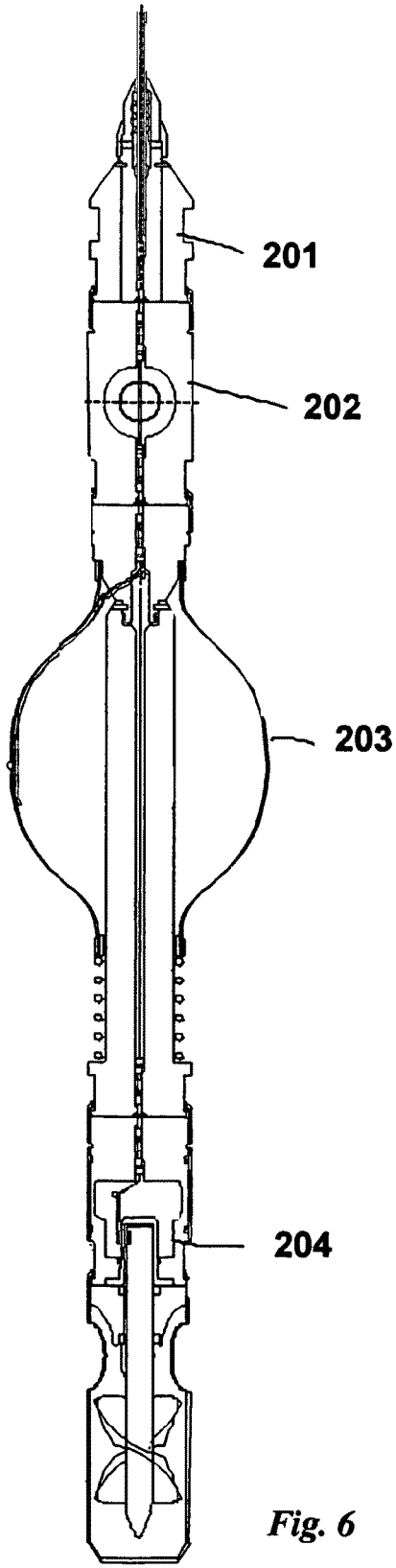
FIG. 6 is a side view of another embodiment of a production logging tool.
Figure 7:
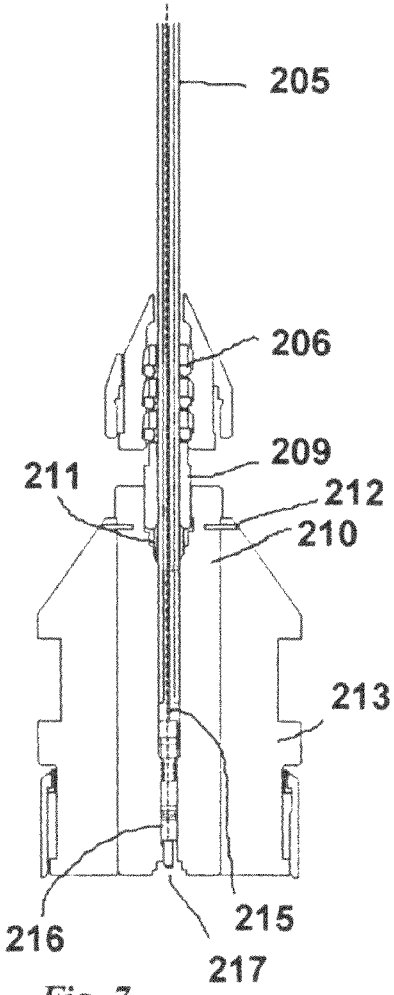
FIGS. 7, 7*a* and 7*b* are sectional views showing attachment of the tool to the slickline.

Referring to FIG. 6, the slickline is attached to the toolstring using a connector 104 with suitable bend/stress reduction at the major anchoring point itself. Various sensors are incorporated, for example (but not limited to) a pressure and temperature sensor 105, casing collar locator 106, gamma ray 107, centralizer activation 108 and turbine flowmeter 109. Referring also to FIG. 7, when measurements are to be taken, particularly flow measurements, the centralizer activation 108 causes the centralizer 110 to expand, centralizing the tool in the tubing, and activates the flow turbine 109.

Referring to FIG. 6, there is shown a production logging tool, built up of various sub assemblies. The sub assemblies are, a connector which secures the tool 201 to the slickline, 202 a pressure and temperature sensor, 203 a centralizer and mechanical casing collar locator tool, 204 a turbine flow meter assembly. Each of these tools will be described in more detail by the following figures.

Figure 7A:
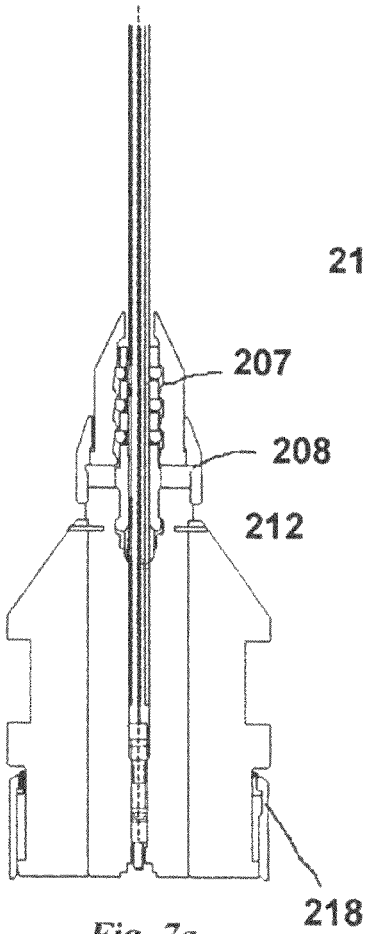
Figure 7B:
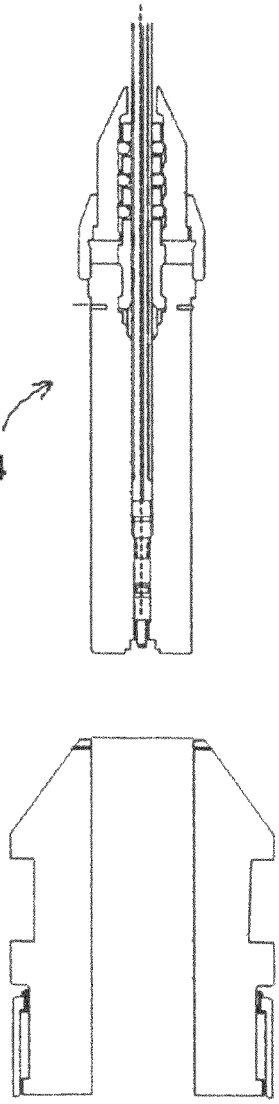

FIGS. 7, 7*a* and 7*b* show a means of mechanical and optically terminating a small diameter metal clad fiber optic tube. The metal clad tube 205 is made up of several layer, so that to grip onto all of the layers and ensure all the layers carry the load, small balls 206 are used which provide low stress points of pip, these are energized by ramps 207, when the nut 208 is made tight. The balls are retained in a body 209, which when screwed into housing 210 energizes a metal to metal seal 211 which seals the metal to metal tube 205 to the housing 210. The housing 210 is attached by a shear pin 212 to a standard connector body 213. In the event the tool string gets stuck, the slickline 205 can be overpulled and the shear pins 212 will fail and the assembly 214 can be recovered to surface. The fiber 215 inside the metal clad tube is fed into a precision fiber optic termination 216 which is retained in the bore of the housing 210. The excess fiber is cut and the face polished 217 to ensure minimum losses. A standard connection coupling 218 is fitted to the end of each coupling which enable the assemblies to be connected without turning the fiber optic connection.

Figure 8:
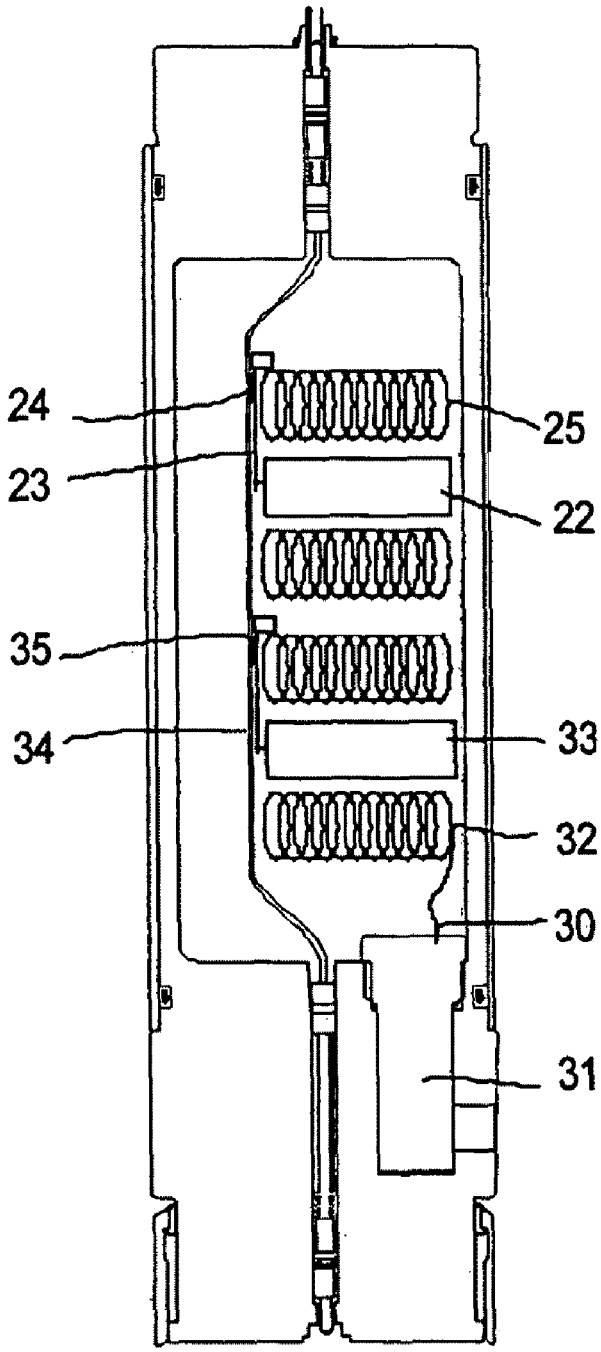
FIG. 8 is a sectional side view of another logging tool in which a battery operated gamma ray detector and casing collar locator are retained and via an interface pass processed information back onto the fiber optic cable via a Bragg grating.

FIG. 8 shows the section side view through a housing. A sensitive coil 25 detects the changes in magnetic field as it passes the extra metal mass at a casing collar. This signal is amplified using a battery 21 and the signal is conveyed to the rod 22 in the coil core. This in turn moves a cantilever beam 23, onto which is attached a Bragg grating sensor 24. Strain changes in the Bragg grating sensor are measured from surface as changes in wavelength, from this casing collar locator (CCL) information can be derived. A scintillating chamber 30 detects gamma rays which measured using a photoelectric cell 31. The quantity or radiation count is converted to a electrical coil 32, which in turn moves a rod 33. This in turn moves a cantilever beam 34, onto which is attached a Bragg grating sensor 35. Strain changes in the Bragg grating sensor are measured from surface as changes in wavelength, from this a gramma ray plot can be generated.

Figure 9:
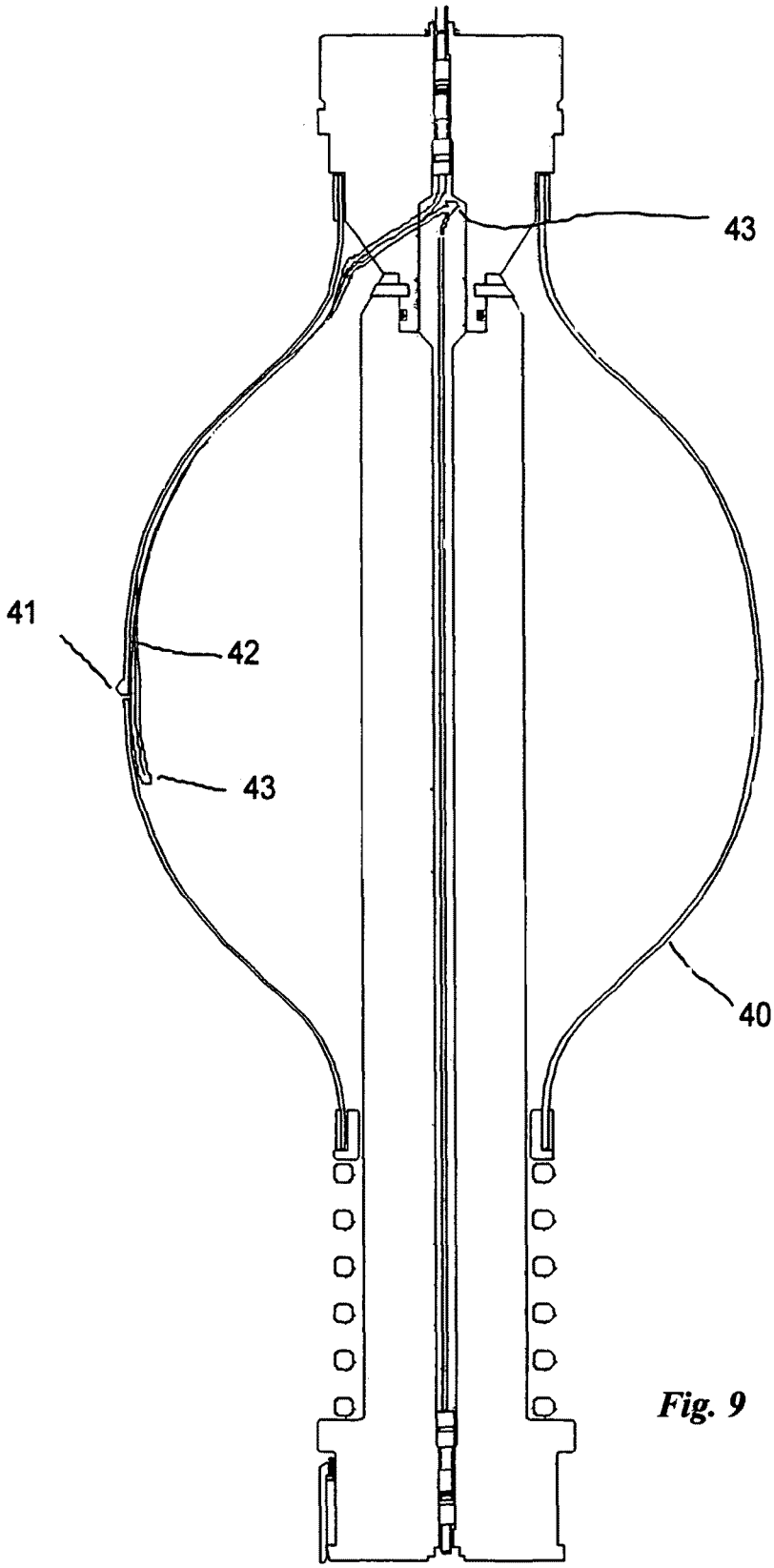
FIG. 9 is a cross section of a mechanical casing collar locator (ccl) again a Bragg grating on the same fiber is used to transmit the information back to surface.

FIG. 9 shows a mechanical version of a CCL. A bow spring centralizer 40 is used to keep the tool centered in the well. Each bow spring 40 is in intimate contact with the tubing and casing internal surface (not shown). At the center of the bow spring is a cantilever 41 button which relaxes to its extended position when a coupling is crossed, this in turn changes the stain for a Bragg grating sensor 42 mounted on the cantilever beam 43. Low loss microbends are used to get the fiber around the mechanical assembly in the most optically efficient means.

Figure 10:
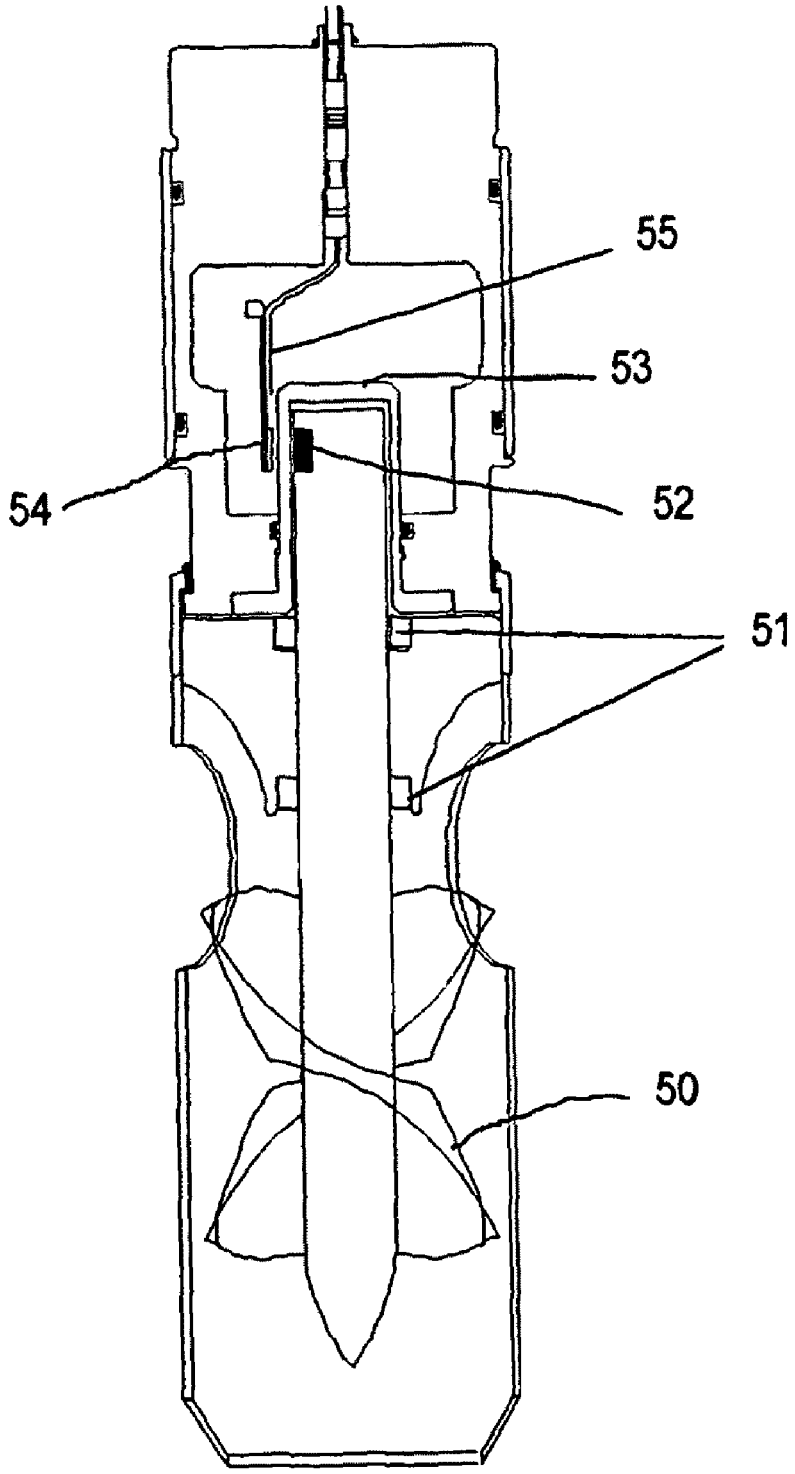
FIG. 10 is a sectional side view of a turbine flowmeter.

Referring to FIG. 10 there is shown the side cross section for a turbine flow meter. An turbine 50 on an axial turbine shaft is supported on bearings 51. A permanent magnet 52 is fitted to the shaft. The sleeve 53 adjacent to the magnet is non-magnetic, and so the cantilever 54 reacts to the effect of the magnet passing by it. Attached to the cantilever beam is a Bragg grating sensor 55. With each rotation of the shaft, the cantilever beam 54 describes one cycle of moving towards and away from the shaft, causing strain changes in the Bragg grating sensor which are measured from surface as changes in wavelength. From this the revolutions of the turbine, and therefore the flow rate, can be derived.

Figure 11:
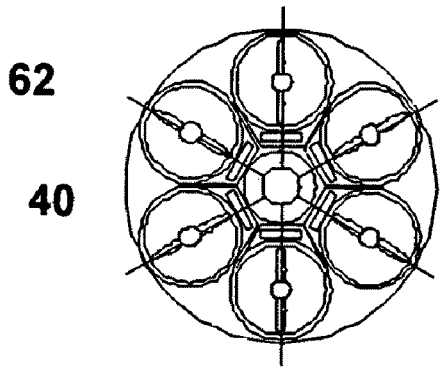
FIG. 11*a* and 11*b* are bottom elevation views of a multi turbine assembly.
Figure 11A:
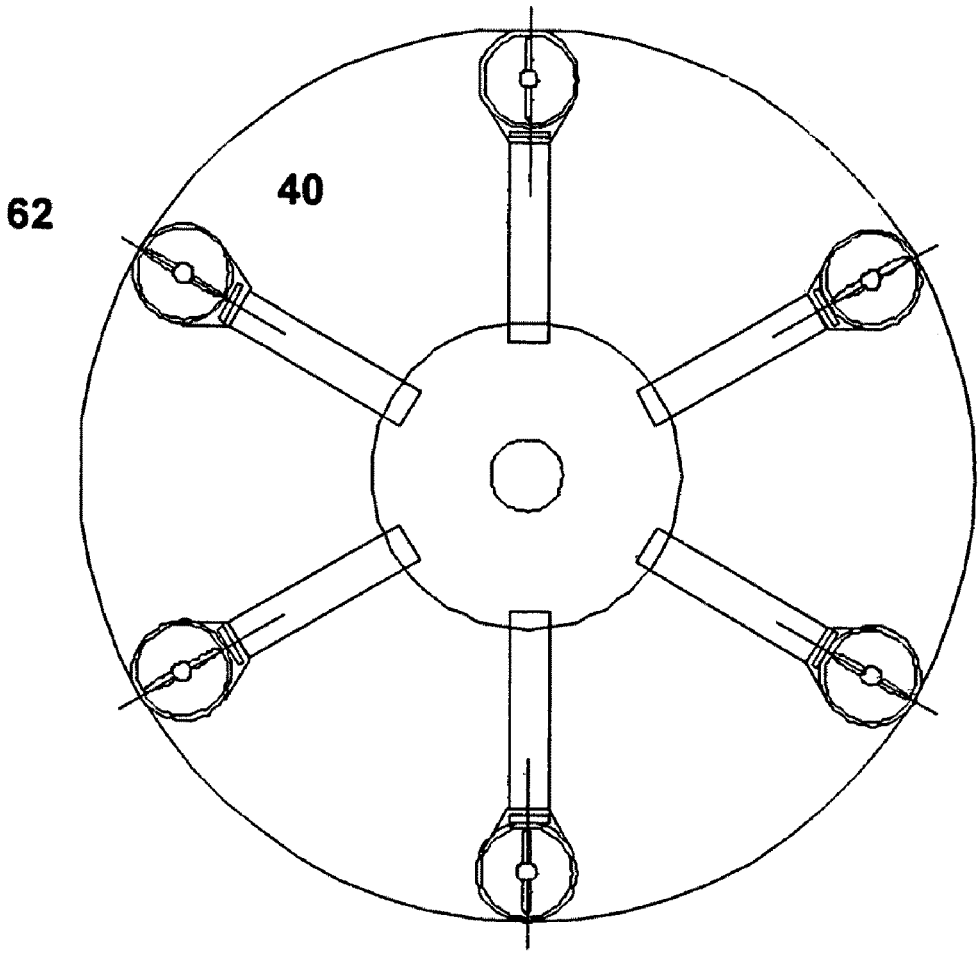
Figure 12:
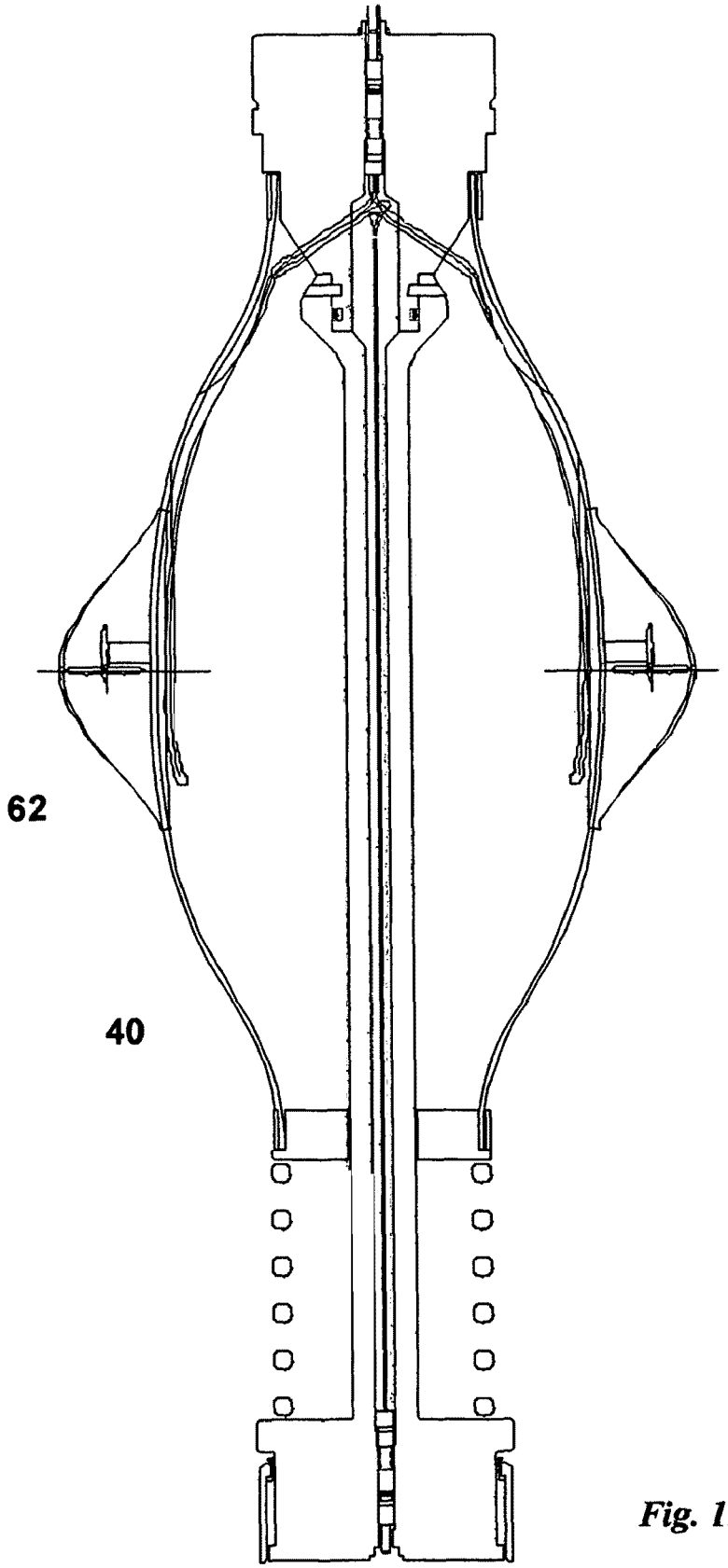
FIG. 12 is a side section view of the flowmeter of FIG. 11.

Referring to FIGS. 11*a* and 11*b* and FIG. 12 miniature flow-measuring turbines 62 may be attached to bow springs 40. This enables flow measurements to be made at specific circumferential sections of the borehole. This would be beneficial in a horizontal well for example where the different phases become layered, i.e. gas on the top layer flowing faster than the oil and water phase on the bottom layer.

Figure 13:
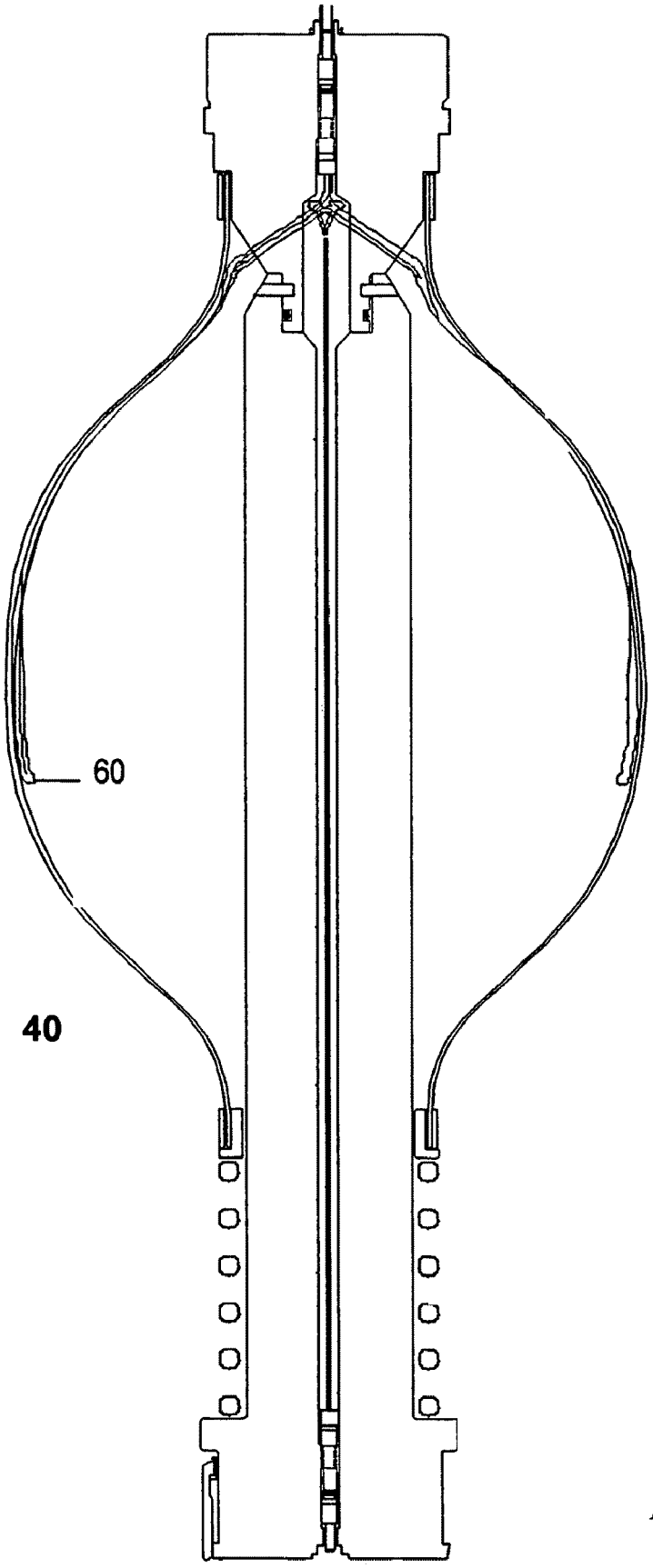
FIG. 13 shows a side view of another embodiment of a logging tool.
Figure 14:
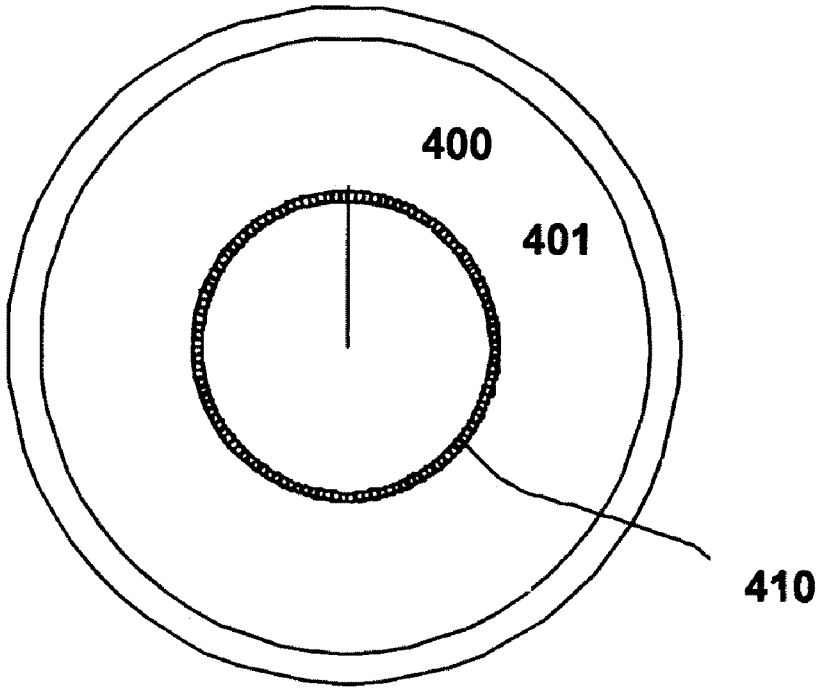
FIG. 14 is an end view of another tool (undeployed) inside a casing.
Figure 15:
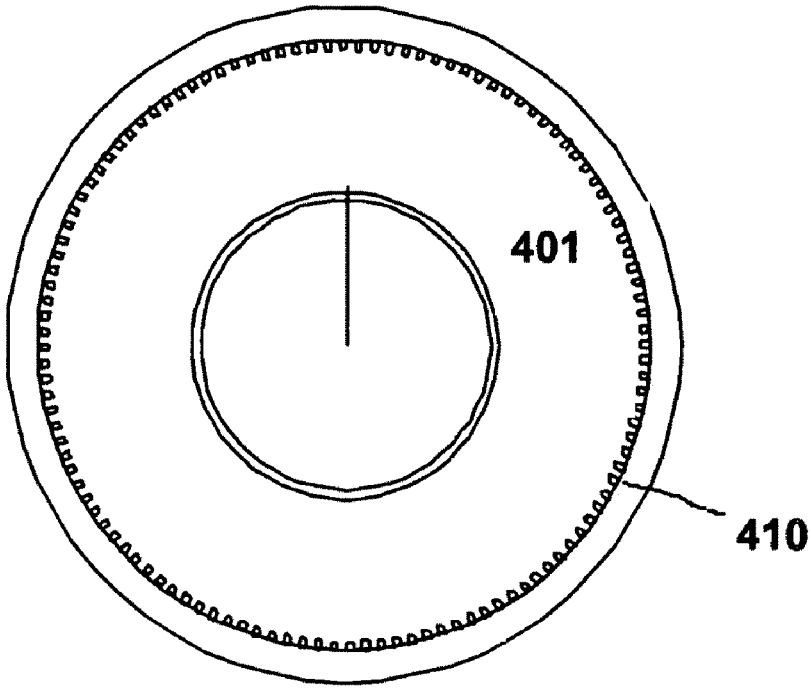
FIG. 15 is an end view of the tool (deployed) inside a casing.

FIG. 13 shows a further embodiment of this invention, using fiber optic acoustic sensors 60 mounted on the bow springs 40 to record the response from a battery powered acoustic source (not shown) used for cement bond logging (CBE's). The acoustic sensors are in intimate contact with the casing (again, not here shown) and produce a picture of the cement bond behind the casing relative to the bow spring they are attached too. Clearly the more bow springs provided around the tool the better the picture generated. As in previous examples, this is a passive measurement and the data is transmitted back to surface via a dedicated fiber/acoustic sensor.

Referring to FIGS. 14 to 18, a sensing tool includes a beryllium copper tube 410 (or a tube of some other springy material) has several slots 400 laser cut in one end. Each solid element 401 that remains after cutting the slots becomes a sensor finger. The fingers 401 are deformed using an expansion mandrel (not shown) until they are set to their maximum measuring diameter shown in FIG. 16. The tube 410 is then heat treated to initiate the spring properties of the material.

Figure 16:
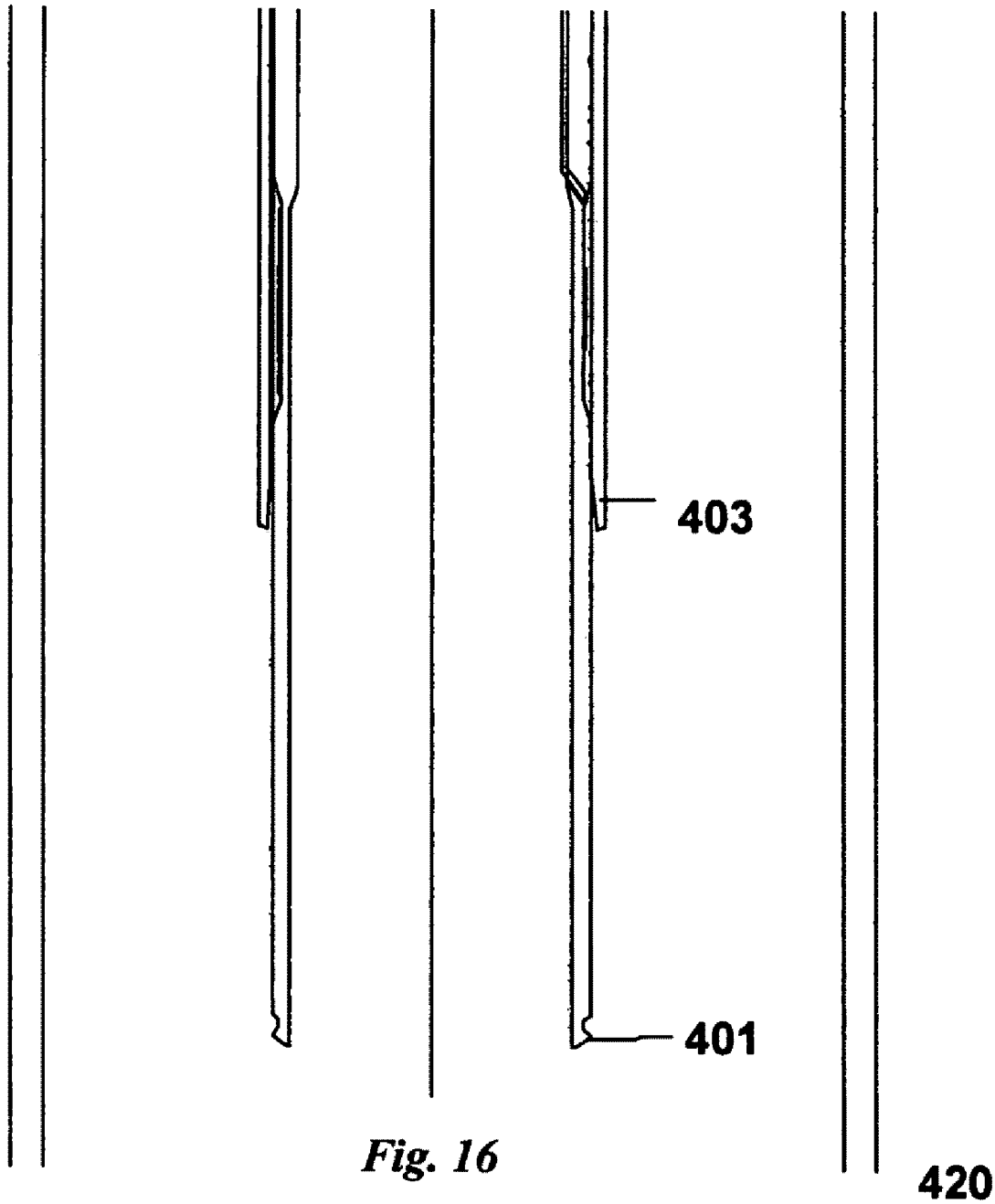
FIG. 16 is a side view of tool of FIG. 15.
Figure 17:
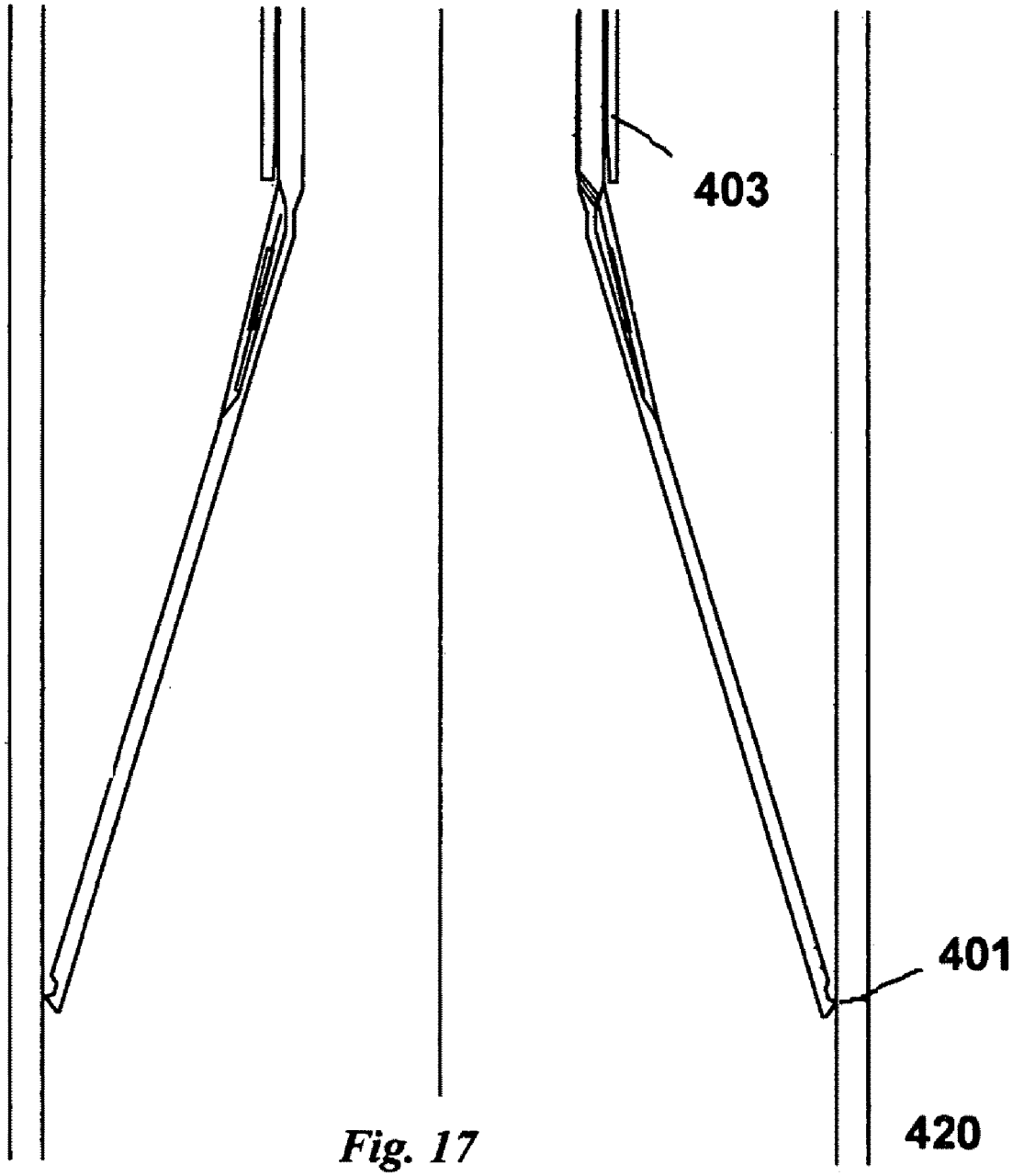
FIG. 17 is a side view of the tool of FIG. 15.
Figure 18:
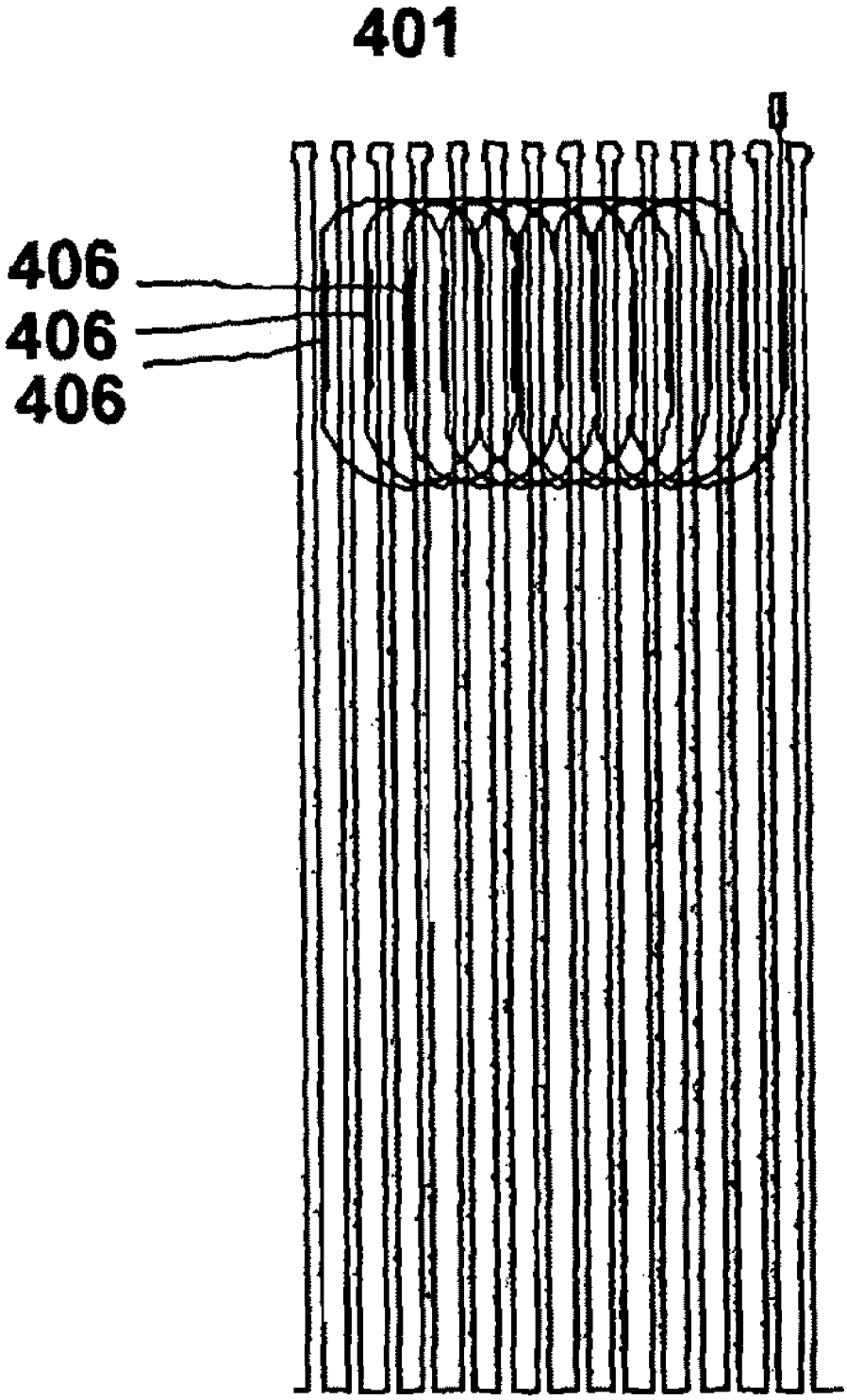
FIG. 18 is a sectional view of the fingers showing the fiber optic cable routing.

Referring to FIG. 16, when the tool is deployed in a casing or production tube 420 a sleeve 403 holds the spring fingers 401 in an undeployed position. When at the required position in the well, the sleeve 403 is retracted from the fingers 401 as shown in FIG. 17, so that the fingers deploy either to there maximum diameter or until they contact the internal surface of the casing 405 they are to measure.

A series of Bragg grating fiber optic sensors 406 are bonded to each finger at their bending point. The fiber has a limited bend radius, so each time the fiber is bent back on itself it misses out several fingers 401, this is repeated around the entire tube, until each the fiber is bonded to each finger.

Each Bragg grating sensor operates at a discrete wave length and so on a single fiber each grating can be individually interrogated to determine its strain and hence its angular deformation and corresponding diameter. One fiber can typically measure up to 128 sensors.

The invention claimed is:

1. A sensor system for use in a wellbore, the sensor system comprising:

a cable adapted to be lowered down the wellbore, having a fiber-optic core surrounded by a a metal cladding, and capable of suspending a load, and a sensor suspended from the cable and having at least one Bragg grating connected to the core and a member contacting an inner surface of the wellbore or a tube in the wellbore and connected to the Bragq grating, whereby strain applied to the Bragq grating by the member is related to the position of the member such that the diameter of the wellbore or tube can be measured.

2. The sensor system according to claim 1 wherein at least one of the Bragg gratings is subjected to a strain related to the wellbore's pressure, such that the pressure can be determined from the characteristics of the Bragg grating.

3. The sensor system according to claim 2 wherein two such Bragg gratings measuring pressure are included with a venturi, and each grating measure the pressure at a different position such that the fluid flow rate in a wellbore can be determined.

4. The sensor system according to claim 1 wherein the fiber-optic cable is incorporated in a wireline leading to the surface.

5. The sensor system according to claim 1 wherein the sensor has a flowmeter that produces a strain on one of the Bragg gratings related to the rate of flow.

6. The sensor system according to claim 1 wherein the sensor has a flowmeter that produces a strain the Bragg grating related to the rate of flow.

7. A sensor system for use in a wellbore, the sensor system comprising:

a cable adapted to be lowered down the wellbore, having a fiber-optic core surrounded by a plurality of swaged tubular metal layers, and capable of suspending a load, and a sensor suspended from the cable and having at least one Bragg grating connected to the core and a member connected to the Bragg grating and contacting an inner surface of the wellbore or a tube in the wellbore, whereby a strain in the Bragg grating is related to the position of the member such that the diameter of the wellbore or tube can be measured.

* * * * *